United States Patent [19]

Byars et al.

[11] 3,981,224

[45] Sept. 21, 1976

[54] MISSILE TRANS PORTER-LAUNCHER

[75] Inventors: Chester W. Byars, Stow; Edgar L. Van Cott, Weston; Clifton F. Orchard, Marblehead, all of Mass.

[73] Assignee: The United States of America as represented by the Secretary of the Army, Washington, D.C.

[22] Filed: July 11, 1975

[21] Appl. No.: 595,190

[52] U.S. Cl. ..... 89/1.815; 89/1.818

[51] Int. Cl.[2] ..... F41F 3/04

[58] Field of Search ..... 89/1.815, 1.818, 1.8, 89/1.816, 40 C

[56] References Cited

UNITED STATES PATENTS

| | | | |
|---|---|---|---|
| 1,354,182 | 9/1920 | Giangiopo | 89/40 C |
| 2,926,798 | 3/1960 | Hamilton | 89/1.815 X |
| 3,137,203 | 6/1964 | Brown | 89/1.818 X |
| 3,710,677 | 1/1973 | Mayer | 89/1.8 |
| 3,753,382 | 8/1973 | Rusbach | 89/1.815 |
| 3,754,497 | 8/1973 | Rusbach | 89/1.815 X |

FOREIGN PATENTS OR APPLICATIONS

| | | | |
|---|---|---|---|
| 1,336,054 | 7/1963 | France | 89/1.818 |
| 1,476,268 | 2/1967 | France | 89/1.815 |

*Primary Examiner*—David H. Brown

*Attorney, Agent, or Firm*—Nathan Edelberg; Robert P. Gibson; Harold W. Hilton

[57] ABSTRACT

A launcher carried on the flatbed of a mobile vehicle to provide the dual role of missile transporter and prelaunch positioning of its multi-missile payload. The launcher is not trainable in azimuth or elevation. When emplaced the launcher carriage erects the missiles to substantially a 75° launch angle and a missile is fired from a combination launch tube shipping container by a small propellant charge and uses its own control to put it on the proper trajectory. Missile motor ignition is delayed for a predetermined time after launch.

5 Claims, 6 Drawing Figures

MISSILE TRANS PORTER-LAUNCHER

BACKGROUND OF THE INVENTION

Previous launcher designs have been of the rail type wherein the missile is forced from the rail by the propulsive force of the booster at booster ignition. The launcher rails are relatively massive and heavy which together with the blast effects from the booster, have limited the number of missiles that could be carried on a single tactical vehicle. Further, the erosion of the ground around the launcher due to the blast from the booster has resulted in severe dust clouds by which means a launch location is easily determined. Where hard stands were not provided, the erosion necessitated relocation of the launcher after missile firing.

The ejection launch eliminates the heavy rails, minimizes blast effects, and thus allows many missiles to be carried on a single vehicle. The minimized erosion eliminates the dust signature clouds and precludes the necessity of relocating the launch vehicle after a missile firing.

The missile transporter-launcher of the present invention includes many significant advantages over previous tactical launchers. Some of the advantages are as follows:

a. fixed angle launch eliminates the need for heavy, costly trainable structure and associated servo and drive equipment.

b. ejection launch with delayed rocket motor ignition allows the missiles to be closely packed without being susceptible to damage due to rocket motor blast.

c. ejection launch allows the missile shipping containers to be also used as a launch tube.

d. the above techniques, in conjunction with the small size of the missile, allows a plurality to be carried within the cargo size and weight restrictions of a tactical vehicle.

e. as a result of the ejection launch, pressure levels on the launcher and surrounding terrain are maintained below 1 PSI, thus soil erosion and dust signatures are reduced to negligible proportions.

SUMMARY OF THE INVENTION

A launcher is mounted on the flatbed of a mobile vehicle, the launcher includes a carriage having fore and aft bulkheads for supporting opposite ends of a plurality of missile containing transport-launch tubes. The aft end is provided with a plurality of combustion devices carried thereby and disposed for ejection-launching of the missile. Power erection means driven from the crankshaft of the transport vehicle raises and lowers the launcher from the horizontal, transport position to the launching position.

It is, therefore, an object of the present invention to provide a missile transporter-launcher from which the missiles are ejection-launched at fixed elevation and bearing angles.

It is another object of the present invention to provide a transporter-launcher in which the launcher derives power for raising and lowering thereof from the drive power of the transporter.

These and other objects and advantages of the present invention will become more readily apparent from the following description and drawings.

DESCRIPTION OF THE PREFERRED EMBODIMENT

Figure 2:
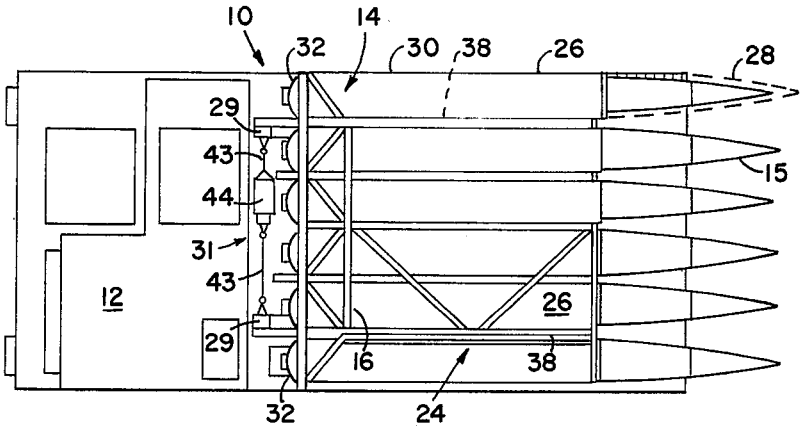
FIG. 2 is a plan view of the transporter-launcher of FIG. 1 having three missiles removed to illustrate the launch carriage.
Figure 1:
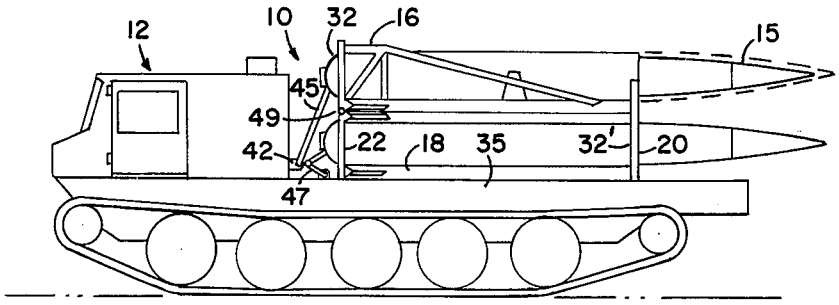
FIG. 1 is an elevational view of the transporter-launcher of the present invention.

As shown in FIG. 1, transporter-launcher 10 includes a mobile vehicle 12 and a launcher 14. The launcher is disposed for carrying a plurality of missiles 15 and includes upper and lower carriages 16 and 18, respectively. Each carriage includes forward and aft bulkheads 20 and 22 which are interconnected with a high strength steel truss 24 (FIGS. 1, 2, 3 and 4).

Each missile is carried in a tube 26 which serves as both a shipping container for the missile and as a launch tube. The tube consists of a forward end cover 28 (FIG. 2) which acts to protect the missile radome during storage, shipment and transport; a constant diameter center section 30 which supports the missile and which also serves as a launch tube; and, an aft cover (not shown) which seals the tube and protects the rocket motor until launch, at which time the aft cover is removed.

Figure 3:
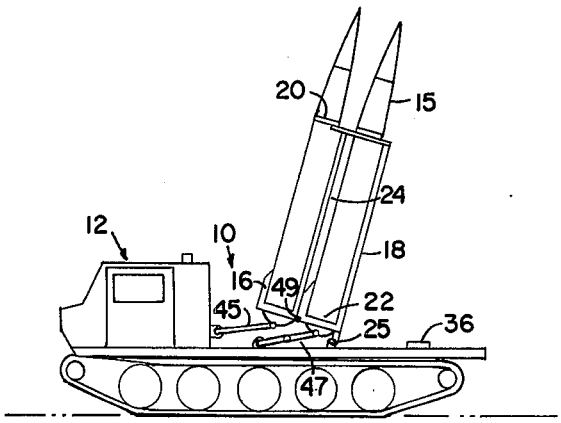
FIG. 3 is an elevational view of the launcher in launching position.
Figure 4:
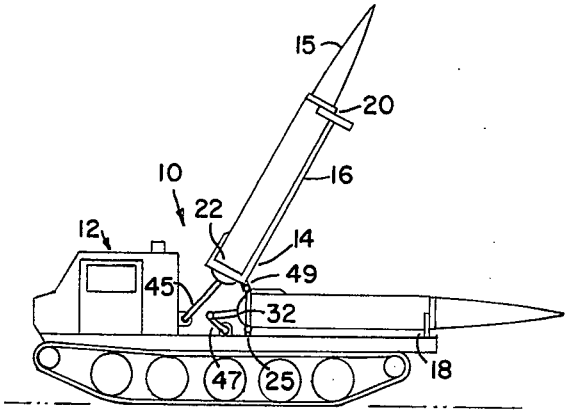
FIG. 4 is an elevational view of the launcher in reload position, having the upper carriage raised.

Load and launching positions for the launch carriage are indicated in FIGS. 3 and 4. When missiles are loaded, the aft protective cover is removed from the shipping container tube and the aft end of the center section of the tube is secured to an ejection combustion chamber 32 (FIGS. 1 and 6) which is a part of aft bulkhead 22 of the launcher carriage. The front end of the center section of tube 26 rests in a saddle 32' (FIG. 1) at the forward bulkhead 20 of the launch carriage. The tube is retained in the carriage by toggle latches at the forward bulkhead (not shown).

Figure 5:
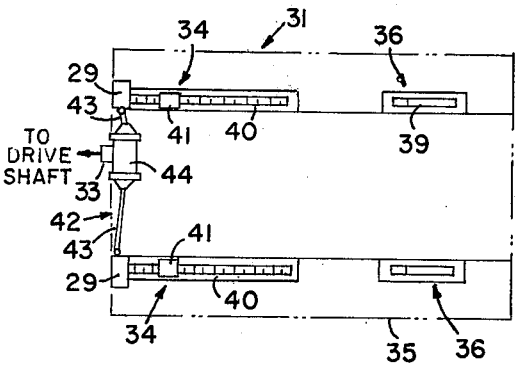
FIG. 5 is an elevational view of the launch carriage drive mechanism, with launch carriage removed.

To raise and lower the launch carriages 16 and 18, a launch carriage drive mechanism 31 is provided (FIG. 5). The drive mechanism 31 is connected to the crankshaft of the vehicle by drive shaft member 33 (FIG. 1). The drive shaft member 33 connects with a speed reducer 44 (FIGS. 4 and 5).

The carriage drive mechanism (FIG. 5) is carried on a platform 35 (FIG. 1) which is secured to the vehicle. The launch carriage drive mechanism includes a pair of carriage support and roller assemblies 34 and a pair of forward carriage support and slide devices 36. Assemblies 34 include a pair of self locking screw activators 40 each secured to a right angle gear box 29 which is interconnected by linkages 43 with speed reducer 44 to synchronize the output. A carriage support member 41 is slidably mounted on screw activator 40 and is pivotally secured to lower truss 24 at position 25 (FIGS. 3 and 4). Support and slide devices include a sliding member 39 which supports truss member 24 and is mounted for slidable movement on platform 35. Pivoted linkage assemblies 45 and 47 are pivotally secured to the vehicle and to upper and lower carriage assemblies 16 and 18, respectively. Assembly 47 includes a pair of arms pivotally secured together at the first ends thereof. The opposite ends of each arm are secured to the track and lower carriage, respectively.

To raise the carriages 16 and 18, screw activators 40 are actuated, through member 33 and gear box 29, and the screw turns on members 41. Members 41 move along the screws to move the carriages toward the rear of the vehicle, pivotally extending linkages 45 and 47. Initial movement of the carriages pivots linkage 45 to restrain the carriage 16 from forward movement so that upper carriage 16 pivots about a pivotal connection 49 between the two carriages so that the upper carriage is moved upwardly as shown in FIG. 4. Additional movement of the screw activators moves lower carriage 18, in similar manner, to the position shown in FIG. 3. That is, the additional movement pivotally extends linkage 47 to the point of restraining the lower carriage from further forward movement, thus causing the lower carriage to pivot about point 25 to its upward position as shown in FIG. 3.

Figure 6:
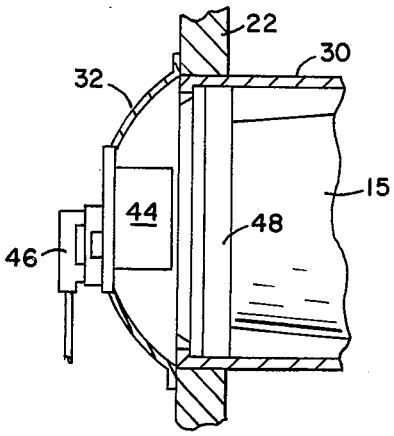
FIG. 6 is a partial sectional view of the launcher combustion chamber.

Ejection launch is accomplished by means of a low pressure hot gas ejection system. As shown in FIG. 6, the combustion chamber assembly 32 is secured in the launch carriage aft bulkhead 22 in mating relation with the missile tube center section 30 having missile 15 therein. A gas generator 44 is disposed in combustion chamber 22 and is connected to an igniter means (not shown) through an umbilical connector 46. A piston 48 is disposed intermediate the aft end of the missile and the gas generator. When the propellant is ignited by the launch command from the data processor, the combustion gases eject the missile from the tube. The propellant charge is sized to obtain an ejection velocity which is sufficient to propel the missile to a safe distance, so that the blast due to motor ignition will not adversely effect the adjacent missiles. The propellant charge, typically, is of solid propellant.

We claim:

1. A missile transporter-launcher for ejection launching of missiles therefrom comprising:

a. a mobile vehicle having a platform thereon;

b. carriage means carried by said platform and having forward and aft ends, said carriage means including a pair of carriages the first of said pair of carriages mounted above the second of said pair of carriages;

c. power erection means carried by said vehicle and operatively connected with said carriage means and the crankshaft of said vehicle for raising and lowering said forward end of said carriage means between a first horizontal position for transporting said missiles and a second inclined position for launch of said missiles; said power erection means including screw activator means secured to said platform, a member slidably carried by said screw activator means and pivotally secured to said second carriage, a linkage secured to the aft end of each said carriage and said vehicle, a carriage support and slide means secured to said platform for support of said carriage means, whereby movement of said screw activator means moves said carriage means toward the rear of said vehicle on said support and slide means, and said linkage is extended for coaction with said screw activator means for raising said carriage means; and, d. a low pressure hot gas ejection system carried by said carriage means for ejection launching of said missiles.

2. A missile transporter-launcher as set forth in claim 1 wherein said carriages are provided with forward and aft bulkheads interconnected by a high strength truss.

3. A missile transporter-launcher as set forth in claim 2 including a plurality of transport launch tubes, said bulkheads being disposed for supporting respective ends of said tubes.

4. A transporter-launcher as in claim 3 wherein said ejection system includes a plurality of combustion devices rigidly carried by said aft bulkhead, each said combustion device defining a combustion chamber having a piston in the forward end thereof, the aft end of the respective transport-launch tube being secured to the fore end of the respective said combustion chamber, whereby, upon ignition of the propellant in a respective combustion chamber, the combustion gases generate a force on the piston therein sufficient to eject a respective one of said missiles from its respective transport-launch tube.

5. A transporter-launcher as in claim 4 wherein each said combustion device includes a solid propellant gas generator located in the aft end of said combustion chamber for providing the propelling force to launch said missiles from their respective launch tube.

* * * * *